US010132281B2

(12) United States Patent
Filippi et al.

(10) Patent No.: US 10,132,281 B2
(45) Date of Patent: Nov. 20, 2018

(54) FLUID INJECTOR

(71) Applicant: Continental Automotive GmbH, Hannover (DE)

(72) Inventors: Stefano Filippi, Castel' Anselmo Collesalvetti (IT); Marco Bartoli, Leghorn (IT); Antonio Liuzzo, Collesalvetti (IT); Tommaso Galgani, Capraia e Limite (IT)

(73) Assignee: CONTINENTAL AUTOMATIVE GMBH, Hannover (DE)

( * ) Notice: Subject to any disclaimer, the term of this patent is extended or adjusted under 35 U.S.C. 154(b) by 531 days.

(21) Appl. No.: 14/507,336

(22) Filed: Oct. 6, 2014

(65) Prior Publication Data

US 2015/0096538 A1 Apr. 9, 2015

(30) Foreign Application Priority Data

Oct. 4, 2013 (EP) ..... 13187341

(51) Int. Cl.
*F02M 61/16* (2006.01)
*F02M 61/18* (2006.01)
*F02M 63/02* (2006.01)

(52) U.S. Cl.
CPC ..... *F02M 61/167* (2013.01); *F02M 61/186* (2013.01); *F02M 61/1853* (2013.01); *F02M 63/0275* (2013.01)

(58) Field of Classification Search
CPC ..... F02M 63/0275; F02M 61/167; F02M 61/1853; F02M 61/186; F02M 61/165;
(Continued)

(56) References Cited

U.S. PATENT DOCUMENTS 4,907,748 A * 3/1990 Gardner ..... F02M 51/0603 239/584
5,484,108 A * 1/1996 Nally ..... F02M 61/1853 239/553.3

(Continued)

FOREIGN PATENT DOCUMENTS

DE 102010064268 A1 6/2012 ..... F02M 51/08
DE 102011080695 A1 2/2013 ..... F02M 61/16

(Continued)

OTHER PUBLICATIONS

European Search Report, Application No. 13187341.6, 5 pages, dated Feb. 21, 2014.

(Continued)

*Primary Examiner* — Alexander Valvis
*Assistant Examiner* — Christopher R Dandridge
(74) *Attorney, Agent, or Firm* — Slayden Grubert Beard PLLC

(57) ABSTRACT

A fluid injector for injecting fuel into a combustion engine includes a valve, a tubular valve body and an orifice disc, wherein the valve comprises valve seat and a movable opening device in order to open and close the valve, wherein the orifice disc is arranged at the valve seat on the opposite side of the opening device and is configured to shape a spray of the fluid dispensed by the fluid injector in an open position of the valve. A compensation element and a fastening element are provided, wherein the compensation element is arranged between the valve seat and the fastening element, wherein the fastening element is configured and arranged to fasten the compensation element to the valve in the valve body in a pre-stressed manner.

18 Claims, 3 Drawing Sheets

(58) Field of Classification Search
CPC ..... F02M 61/168; F02M 2200/8092; F02M 2200/505; F02M 2200/80; F02M 2200/8061
USPC ... 239/585.1, 533.2, 533.9, 584, 575, 585.3, 239/533.3, 533.4, 533.6, 533.7, 533.11, 239/533.12, 585.2, 585.5, 585.4
See application file for complete search history.

(56) References Cited

U.S. PATENT DOCUMENTS

| | | | | |
|---|---|---|---|---|
| 5,823,444 | A * | 10/1998 | Reiter | F02M 61/1853 239/533.12 |
| 5,865,158 | A * | 2/1999 | Cleveland | F02D 41/3005 123/478 |
| 6,405,935 | B2 * | 6/2002 | Dantes | F02M 61/162 239/5 |
| 8,919,372 | B2 | 12/2014 | Fischetti et al. | 137/514.7 |
| 9,347,412 | B2 | 5/2016 | Fath et al. | |
| 2002/0179742 | A1 | 12/2002 | Yildirim et al. | 239/533.3 |
| 2003/0085309 | A1 * | 5/2003 | Iwano | F02M 51/0682 239/585.1 |
| 2004/0061005 | A1 | 4/2004 | Hokao | 239/533.12 |
| 2014/0001288 | A1 | 1/2014 | Albrodt et al. | 239/533.3 |
| 2014/0252132 | A1 | 9/2014 | Jeannel et al. | 239/482 |

FOREIGN PATENT DOCUMENTS

| | | | | |
|---|---|---|---|---|
| DE | 102012211665 | A1 | 2/2013 | F02M 59/36 |
| EP | 1267069 | A2 | 12/2002 | F02M 51/06 |

OTHER PUBLICATIONS

Chinese Office Action, Application No. 201410516501.5, 12 pages, dated Jul. 18, 2017.

* cited by examiner

FLUID INJECTOR

CROSS-REFERENCE TO RELATED APPLICATIONS

This application claims priority to EP Patent Application No. 13187341 filed Oct. 4, 2013. The contents of which are incorporated herein by reference in their entirety.

TECHNICAL FIELD

The invention relates to a fluid injector, in particular for injecting fuel into a combustion engine, the fluid injector comprising: a valve, a tubular valve body and an orifice disc, wherein the valve comprises a movable opening device to open the valve, wherein the orifice disc is arranged at the valve on the opposite side of the opening device and is configured to define a spray quality of the fluid dispensed by the fluid injector, and in particular injected into the combustion engine, in an open position of the valve.

BACKGROUND

DE 10 2010 064 268 A1 teaches a fuel injector for injecting a fuel into a combustion engine. The fuel injector comprises an electromagnetic actuator, a movable valve needle and a valve closing body. At the downstream side of the valve seat, an orifice disc is arranged in order to define a spray quality of the valve. The orifice disc is welded to the valve seat. In order to weld the orifice disc to the valve seat, the orifice disc has to comprise a certain predefined thickness.

SUMMARY

One embodiment provides a fluid injector for injecting fuel into a combustion engine, the fluid injector comprising: a valve, a tubular valve body and an orifice disc, wherein the valve comprises a valve seat and a movable opening device interacting with the valve seat to open and close the valve, wherein the orifice disc is arranged at the valve seat on the opposite side of the opening device and is configured to shape a spray of the fluid dispensed by the fuel injector in an open position of the valve, wherein a compensation element and a fastening element, wherein the compensation element is arranged between the valve seat and the fastening element, and wherein the fastening element is configured and arranged to fasten the compensation element to the valve in the valve body in a pre-stressed manner.

In a further embodiment, the compensation element comprises at least one of the following materials: polytetrafluorethylene, a high temperature-resistant plastic, a material which is not weldable to metal.

In a further embodiment, the compensation element is configured and arranged to allow a movement of the orifice disc relative to the valve seat.

In a further embodiment, the valve comprises an opening, wherein the opening device clears the opening in an open position of the valve, wherein the compensation element is ring-shaped so that it comprises a central opening, and wherein the central opening overlaps with the opening of the valve.

In a further embodiment, the fluid injector includes a high pressure area limited by the valve seat of the valve and the valve body, wherein the compensation element is configured to contribute to sealing off the high pressure area.

In a further embodiment, the fastening element comprises a mounting ring, wherein the mounting ring is connected to an inner peripheral surface of the valve body, wherein the orifice disc is arranged between the mounting ring and the valve seat.

In a further embodiment, the mounting ring provides at least a clamping connection to the inner peripheral surface of the valve body.

In a further embodiment, the mounting ring is welded to the inner peripheral surface of the valve body.

In a further embodiment, the compensation element is arranged between the mounting ring and the orifice disc.

In a further embodiment, the compensation element is arranged between the valve seat and the orifice disc.

BRIEF DESCRIPTION OF THE DRAWINGS

Example embodiments of the present invention are described in more detail below with reference to the accompanying drawings, in which.

DETAILED DESCRIPTION

Figure 1:
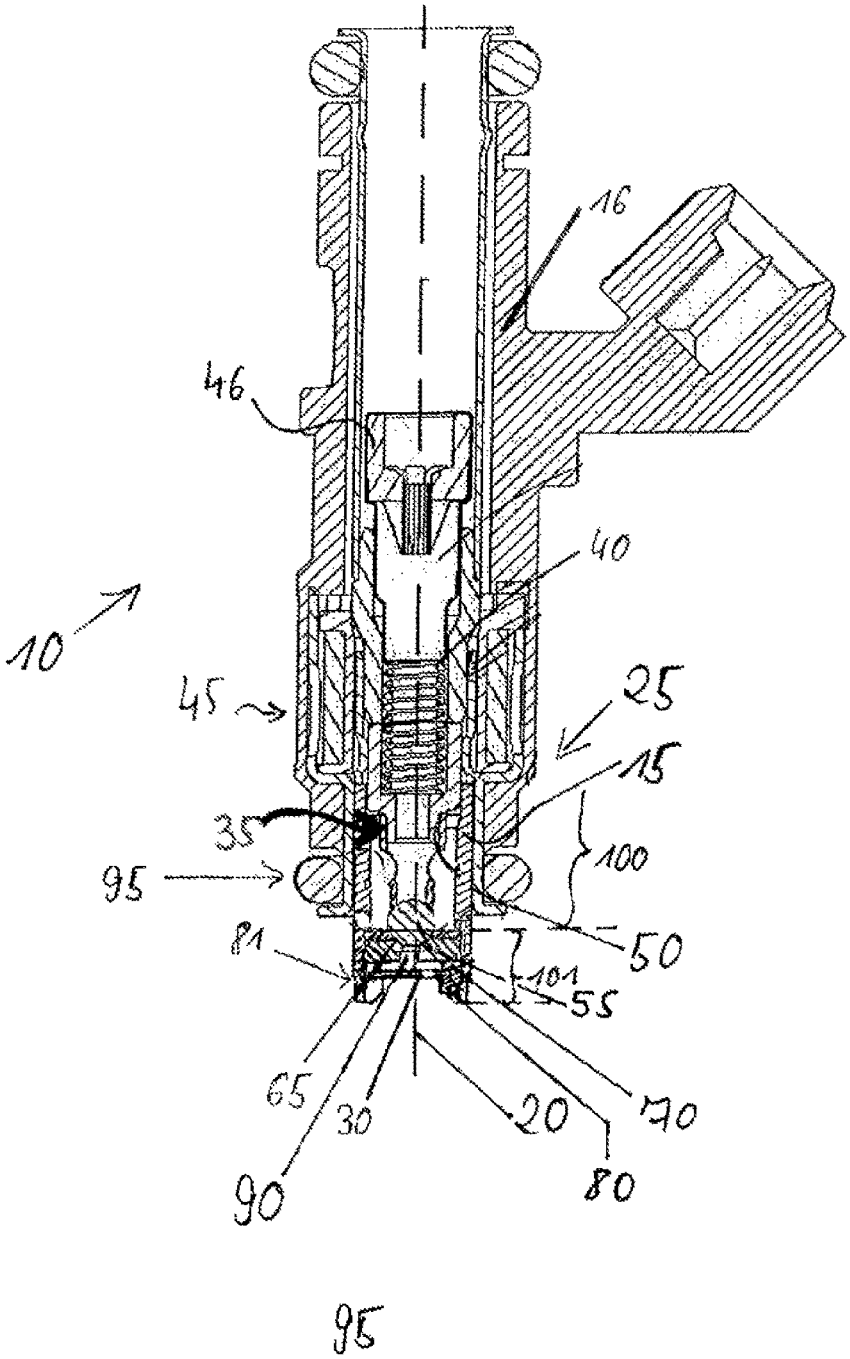
FIG. 1 depicts a longitudinal section view of a fuel injector according to a first embodiment.

Embodiments of the present invention provide an improved fluid injector.

According to some embodiments, it has been recognized that an improved fluid injector may be provided by a fluid injector comprising a valve, a tubular valve body and an orifice disc. The valve comprises a movable opening device and a valve seat. The opening device in particular comprises a valve needle. The opening device rests on the valve seat in a closed position of the valve. The orifice disc is arranged at the valve seat on the opposite side of the opening device and is configured to define a spray quality of the fluid dispensed by the fluid injector—and in particular injected into the combustion engine—in an open position of the valve.

That the orifice disc is arranged at the valve seat on the opposite side of the opening device means in particular that the orifice disc is positioned downstream of the opening device and preferably also downstream of the valve seat. The opening device may expediently be positioned largely upstream of the valve seat. For example only a portion of the needle tip of the valve needle projects beyond the valve seat in downstream direction. The valve seat may expediently be comprised by a valve seat body. In this case the opening device is positioned upstream of the valve seat body and the orifice disc is positioned downstream of the valve seat body.

That the orifice disc is configured to define a spray quality of the fluid dispensed by the fluid injector means in particular that the orifice disc is configured to shape the fluid spray which is dispensed by the fuel injector. The orifice disc has one or more injection holes for shaping the fluid spray.

Furthermore, a compensation element and a fastening element are provided wherein the compensation element is arranged between the valve seat and the fastening element, in particular between the valve seat body and the fastening element. The fastening element is configured and arranged to fasten the compensation element against the valve in the valve body in a pre-stressed manner.

This configuration avoids crack formations and guarantees a correct flow and spray behavior during the product life time. Moreover, a number of degrees of freedom in designing the orifice disc can be raised. Additionally, the orifice disc can be realized by the same production process by limitation of strips and hole formations. Furthermore, there is no limitation to a thickness of the orifice disc in order to avoid any cracks after assembling the orifice disc. This results in a better spray quality of the fluid injector.

In one embodiment, the compensation element is configured to allow a movement of the orifice disc relative to the valve seat—in particular relative to the valve seat body. For example, expansion and contraction of the orifice disc relative to the valve seat body and/or the tubular valve body may be enabled in this way. Such relative expansion and contraction can occur for example due to temperature changes effected by the combustion process or by changing temperature of the surroundings. With advantage, mechanical stress due to different thermal expansion of the orifice disc with respect to the tubular valve body or the valve seat body can be particularly small in this way.

In a further embodiment, the compensation element comprises at least one of the following materials: polytetrafluorethylene, high temperature-resistant plastic, material which cannot be welded to metal. These materials guarantee that the orifice disc can bend during injection of the fluid by the fluid injector and the orifice disc can move slightly against this valve seat or the mounting ring.

In one embodiment, the valve comprises an opening wherein the opening device clears the opening in an open position of the valve. The opening is in particular a through-hole through the valve seat body. The compensation element is ring-shaped so that it comprises a central opening. For example, the compensation element is a washer, i.e. it has a toroidal shape, is in the shape of a hollow cylinder or in the shape of a perforated disc. The central opening overlaps with the opening of the valve. In other words, the compensation element, in top view of the opening, extends circumferentially around the opening of the valve and does not overlap the opening. This design provides an optimal fluid flow through the injector and the compensation element does not influence the spray quality of the injector.

In a further embodiment, the fuel injector comprises a high pressure area limited by the valve seat of the valve and the tubular valve body. The compensation element is configured to contribute to sealing the high pressure area, in particular to a combustion chamber of the combustion machine. For example, the compensation element represents a ring-seal at an interface between the valve seat body and the orifice disc, the ring-seal extending completely circumferentially around the opening of the valve. This configuration guarantees that fluid is dispensed only through the injection holes of the orifice disc and reduces the risk that the fuel injector leaks into the low pressure area. The compensation element can also be operable to seal the high pressure are at an interface between the valve seat body and the valve body.

In a further embodiment, the fastening element comprises a mounting ring. The mounting ring is connected to an inner peripheral surface of the valve body. The orifice disc is arranged between the mounting ring and the valve seat. This design allows a tension of the orifice disc during the injection process without damaging the orifice disc.

In a further embodiment, the mounting ring provides at least a clamping connection to the inner peripheral surface of the valve body. For example, the clamping connection is a friction-fit. This configuration provides a reliable connection between the mounting ring and the valve body during the manufacturing process of the fuel injector.

In a further embodiment, the mounting ring is welded to the inner peripheral surface of the valve body, in particular additionally or alternatively to the friction-fit connection. This connection between the mounting ring and the valve body is reliable over the product life time.

In a further embodiment, the compensation element is arranged between the mounting ring and the orifice disc. This configuration can be easily mounted.

In a further embodiment, the compensation element is arranged between the valve seat and the orifice disc. This configuration can be easily mounted, as well.

Figure 2:
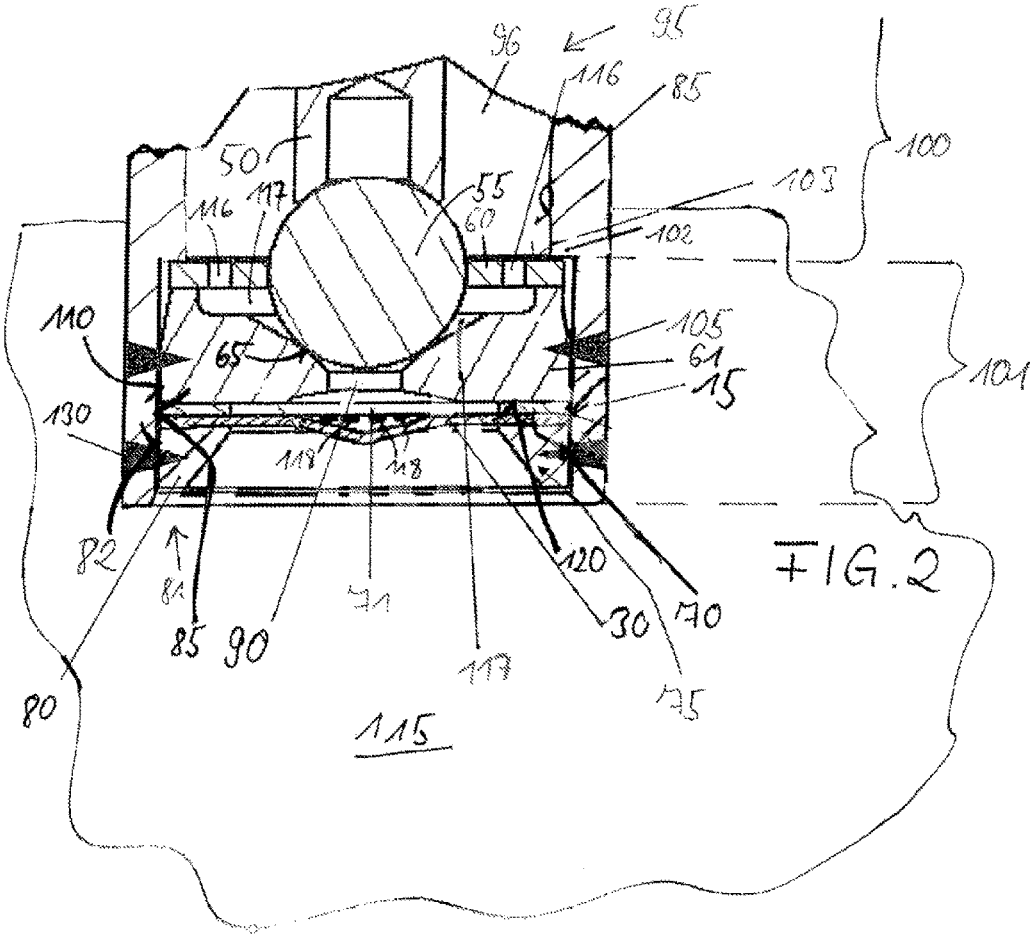
FIG. 2 shows a detail of the longitudinal section view of the fuel injector shown in FIG. 1.

FIG. 1 shows a longitudinal section through a fluid injector 10 according to a first embodiment. FIG. 2 shows a detail of the longitudinal section shown in FIG. 1. The fluid injector 10 is a fuel injector for injecting fuel as the fluid 96 into an intake manifold or into a combustion chamber 115 of an internal combustion engine.

The fuel injector 10 comprises a tubular valve body 15 and a casing 16 which share a longitudinal axis 20. The tubular valve body 15 is arranged in the casing 16. The fuel injector 10 also comprises a valve 25 and an orifice disc 30. The orifice disc 30 has a plurality of injection holes 118 through which the fluid injector 10 dispenses the fluid 96.

The valve 25 comprises a movable opening device 35. The opening device 35 comprises a spring 40, a calibration element 46 and a tubular needle 50. The calibration element 46 is fastened to the valve body 15 and preloads the spring 40. The spring 40 is arranged between the calibration element 46 and the needle 50 so that is biases the needle 50 towards a closing position. The fluid injector 10 further comprises an actuator assembly 45 for axially displacing the tubular needle 50.

The valve 25 comprises a valve closing member 55, which is comprised by the tubular needle 50, and a valve seat 65. The valve closing member 55 is positioned at the end of the needle 50 opposite to the spring 40. The valve closing member 55 is ball-shaped.

The valve seat 65 is comprised by a valve seat body 61. In a closed position of the valve 25, the valve closing member 55 rests on the valve seat body 61 so that it abuts the valve seat 65.

A valve disc 60 is provided for axially guiding the valve closing member 55. The valve disc 60 is arranged adjacent to the needle 50. The valve seat body 61 is arranged beneath the valve disc 60.

On the side remote from the needle 50, the valve seat body 61 is arranged next to a compensation element 70. The compensation element 70 is ring-shaped and has a flat structure. In other words, it is in the shape of a flat perforated disc. The compensation element 70 comprises a central opening 71. The compensation element 70 is in contact with the orifice disc 30 and the valve seat body 61. Underneath, i.e. downstream of the orifice disc 30 a fastening element 75 is arranged. The fastening element 75 comprises a mounting ring 80 which provides a clamping connection 81 of an outer peripheral surface 82 of the mounting ring 80 to an inner peripheral surface 85 of the valve body 15.

The fluid injector 10 comprises a high pressure area 95. In the region of the fluid outlet portion of the fluid injector 10, the high pressure area 95 is delimited by the valve body 15 and the valve seat 65. The high pressure area 95 is flooded with pressurized fuel 96 coming from a fuel injection pump or a rail system.

The valve body 15 has a first section 100 and a second section 101. In one embodiment, the first section 100 has a smaller inner diameter than the second section 101. The needle 50 is arranged in the first section 100. The valve seat 65 is arranged in the second section 101. Between the first section 100 and second section 101, the valve body 15 has a ledge 102. The ledge 102 is in particular an interface of the first and second sections 100, 101. A top surface 103 of the valve seat body 61 or the valve disc 60 contacts the ledge 102. Due to the contact of the ledge 102 with the top surface 103, the longitudinal position can easily be defined when mounting the valve seat 65 in the valve body 15. Alternatively, the longitudinal position of the valve seat 65 can be defined in a different manner. As a result, it is for example not essential to provide the ledge 102.

In order to secure the position of the valve seat 65 in the valve body 15, the valve seat body 61 is welded to the valve body 15 by means of a first welded connection 105. The first welded connection 105 connects an outer peripheral surface 110 of the valve seat body 61 to the inner peripheral surface 85 of the valve body 15. The first welded connection 105 can be carried out as a spot-welded connection.

Between the orifice disc 30 and the valve seat body 61, the compensation element 70 is arranged. The compensation element 70 is squeezed in between the valve seat 65 and the orifice disc 30. By squeezing in the compensation element 70 between the orifice disc 30 and the valve seat 65, a sealing-off of the high pressure area 95 against a low pressure area, which could for example be the combustion chamber 115 or an intake manifold of a combustion engine, can be provided. With advantage, a fluid tight, ring-shaped weld between the valve seat body 61 and the valve body 15 is not necessary since the compensation element 70 is operable to seal the high pressure area 95 at the interface between the outer peripheral surface 110 of the valve seat body 61 and the inner peripheral surface 85 of the valve body 15. In addition, the compensation element 70 establishes a ring seal extending circumferentially around the injection holes 118 of the orifice disc 30 so that fluid is leaving the fluid injector 10 through the injection holes 118 only, and fluid leakage through peripheral interfaces of the components of the fluid injector 10 is avoided.

In a closed position of the valve 25, the spring 40 presses the needle 50 and the valve closing member 55 against the valve seat 65. In this way, the valve closing member 55 cooperates with the valve seat 65 to close a first opening 90 in the valve seat body 61 so that no fuel is dispensed from the fluid injector 10 when the valve 25 is in the closed position. The first opening 90 is arranged coaxially with the longitudinal axis 20.

The valve disc 60 comprises second openings 116. The second opening 116 are laterally offset with regard to the valve closing member 55. The valve seat body 61 and the valve disc 60 define a duct 117 which connects the second opening 116 with the first opening 90.

In order to open the valve 25, the actuator assembly 45 displaces the needle 50 with the valve closing member 55 in axial direction 20 away from the valve seat 65 and towards the calibration element 46 against the bias of the spring 40. In this way, a gap between the valve seat 65 and the closing member 55 is established so that the fluid 96 coming from the duct 117 can pass through the gap, through the first opening 90 of the valve seat body 61 and through the central opening 71 of the compensation element 70 to the orifice disc 30. The fluid 96 is then dispensed through the injection holes 118 of the orifice disc 30 from the fluid injector 10. After passing the injection holes of the orifice disc 30, the fuel 96 can be injected into the combustion chamber 115 or the intake manifold.

The central opening 71 overlaps with the first opening 90 and the injection holes 118, so that the fuel 96 flows downstream through the compensation element 70 and the orifice disc 30. The injection holes 118 are used to define the spray quality and spray behavior of the fuel injector 10. The orifice disc 30 can comprise different numbers and shape and positions of injection holes 118, for example in order to manipulate the fuel flow in the combustion chamber 115 and influence the combustion of fuel in the combustion chamber 115.

By providing the compensation element 70 in close proximity to the orifice disc 30, a constant flow and spray behavior of the orifice disc 30 over the product life time can be provided. It can also be avoided that the orifice disc 30 cracks during operation of the fuel injector 10. An additional advantage of the compensation element 70 is that the orifice disc 30 can be realized by the same process in which common orifice discs are manufactured. Traditionally, there is no limitation in the thickness of the orifice disc 30 so that the number of degrees of freedom to design the orifice disc 30 is raised and a better spray quality can be achieved with a new design of the orifice disc 30. Also, a possible cracking of the orifice disc 30 during assembling the fuel injector 10, especially when the orifice disc 30 is welded with a valve seat 65, could be avoided.

When the valve 25 is in an open position, fuel is pressed through the injection holes 118 of the orifice disc 30. Due to the pressure of the fuel 96, the orifice disc 30 may bends in a direction away from the opening device 35. The bending of the orifice disc 30 results in a micro-movement against the valve seat 65. By arranging the compensation element 70 between the orifice disc 30 and the valve seat 65, the micro-movements of the orifice disc 30 are compensated by the compensation element 70. In order to provide a reliable compensation function through compensating element 70, the compensating element comprises at least one of the following materials: polytetrafluorethylene, high temperature-resistant plastic, material which cannot be welded to metal.

Downstream or, respectively, on the lower side of the orifice disc 30, the mounting ring 80 presses the orifice disc 30 and the compensation element 70 against a lower surface 120 of the valve seat body 61. In order to easily manufacture the fuel injector 10, at first the valve seat body 61 is inserted into the valve body 15 until the top surface 103 contacts the ledge 102. Afterwards, the outer peripheral side 110 of the valve seat body 61 is welded onto the peripheral side of the valve body 15. Next, the compensation element 70 and the orifice disc 30 are inserted into the valve body 15. Subsequently, the mounting ring 80 pressed into the valve body 15 so that it presses the orifice disc 30 against the compensation element 70 to pre-stress the compensation element 70. The mounting ring 80 presses against the inner peripheral surface 85 of the valve body 85 with its outer peripheral surface 82 and provides a friction-fit connection 81 between the mounting ring 80 and the valve body 15. Through the friction-fit connection 81, the position of the mounting ring 80 with respect to the valve body 15, and thus also the positions of the compensation element 70 and the orifice disc 30, can be predefined. Afterwards, at its outer peripheral surface 82, the mounting ring 80 is welded to the valve body 15 in order to provide a second welded connection 130 which is fixes it position reliable over the life time of the fuel injector 10. Due to the sealing function of the compensation element 70, the second welded connection 130 between the mounting ring 80 and the valve body 15 can be a spot-welded connection which is sufficient for securing the orifice disc 30 and the pre-stress of the compensation element 70.

Figure 3:
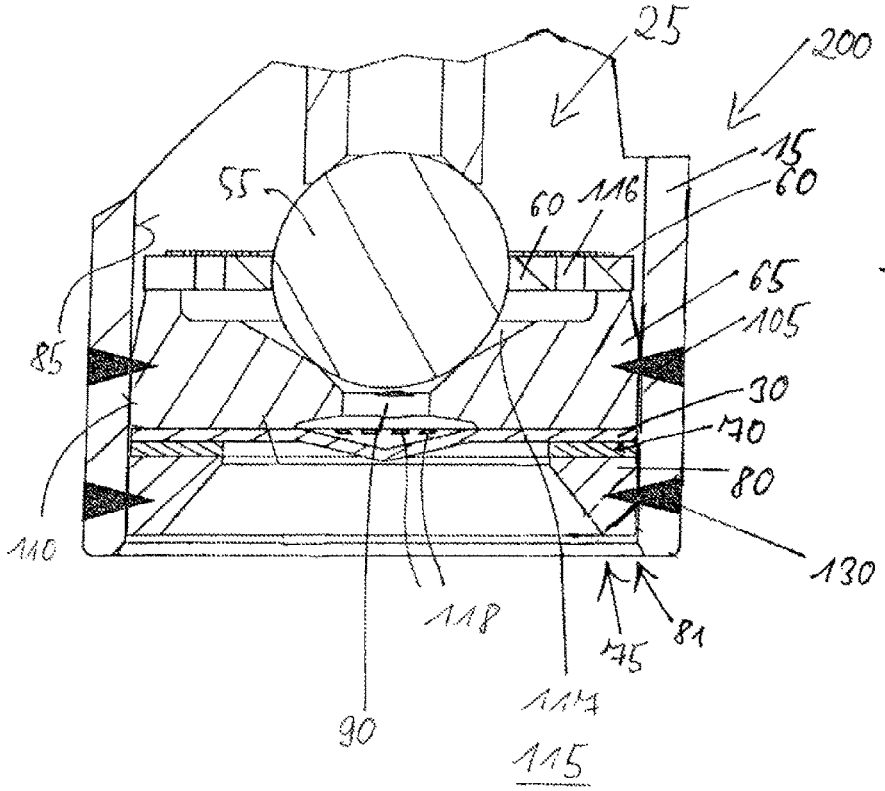
FIG. 3 shows a detail of a longitudinal section view of a fuel injector according to a second embodiment.

FIG. 3 shows a detail of a longitudinal section of a fluid injector 200 according to a second embodiment.

The fluid injector 200 is designed in a similar manner as the fluid injector 10 shown in FIGS. 1 and 2. Deviating from the first embodiment, the compensation element 70 is arranged between the orifice disc 30 and the mounting ring 80. This arrangement has the advantage that the orifice disc 30 could be easily plugged into the valve body 15 when mounting the fluid injector 200. Also, the flow of the fuel through the second openings 116, the first opening 90 and the injection holes 118 is not influenced by the distance between the orifice disc 30 and the valve seat 65 due to the presence of the compensation element 70 between these two parts, as in the first embodiment of FIGS. 1 and 2.

As an additional, optional difference, the valve body 15 does not comprise the ledge as shown in FIGS. 1 and 2. Therefore, the position of the valve seat 65 is defined by the first welded connection 105 and the valve disc 60 is fixed to the valve seat body 61 in the present embodiment. The first weld connection 105 may be a fluid-tight ring weld in the present embodiment.

Alternatively to the second welding connection 130, a continuous welded connection could be provided between the mounting ring 80 and the valve body 15 in order to connect the mounting ring 80 with the valve body 15. Also, the arrangement of the compensation element 70 between the mounting ring 80 and the orifice disc 30 allows the orifice disc 30 to bend slightly when fuel presses onto the openings 90, 116, 118 when the valve 25 is in an open position.

The embodiments shown in the FIGS. 1 to 3 provide a reliable fluid injector 10 with a higher degree of freedom in design in order to easily adopt the spray quality to the design of the combustion chamber of the combustion process. In the shown embodiment, when designing the orifice disc, the designer is not obliged to couple the thickness of the orifice disc with the diameter of the injection holes 118 in the orifice disc 30 for reasons of resistance against mechanical stress due to bending of the orifice disc 30. Through this new designs of the orifice disc 30 with a difference spray behaviors are achievable.

What is claimed is:

1. A fluid injector for injecting fuel into a combustion engine, the fluid injector comprising:

a valve, a tubular valve body, an orifice disc, wherein the valve comprises a valve seat and a movable opening device interacting with the valve seat to open and close the valve, wherein the orifice disc is arranged at the valve seat on the opposite side of the opening device and is configured to shape a spray of the fluid dispensed by the fuel injector in an open position of the valve, a ring-shaped compensation element with a circular central hole, wherein the compensation element comprises at least one of: polytetrafluorethylene, a high temperature-resistant plastic, or a material that is not weldable to metal, and a fastening element secured to a cylindrical inner surface of the tubular valve body at a selectable location along a longitudinal length of the tubular valve body to compress the orifice disc and compensation element against the valve seat body, wherein the compression of the compensation element between the valve seat and the fastening element forms a circumferential seal against the cylindrical inner surface of the tubular valve body.

2. The fluid injector of claim 1, wherein the compensation element is configured and arranged to allow a movement of the orifice disc relative to the valve seat.

3. The fluid injector of claim 1, wherein the valve comprises an opening, wherein the opening device clears the opening in an open position of the valve, wherein the compensation element is ring-shaped and defines a central opening, and wherein the central opening overlaps with the opening of the valve.

4. The fluid injector of claim 1, wherein the fastening element is a mounting ring, wherein the mounting ring is connected to an inner peripheral surface of the valve body, and wherein the orifice disc is arranged between the mounting ring and the valve seat.

5. The fluid injector of claim 4, wherein the mounting ring provides a clamping connection to the inner peripheral surface of the valve body.

6. The fluid injector of claim 4, wherein the mounting ring is welded to the inner peripheral surface of the valve body.

7. The fluid injector of claim 4, wherein the compensation element is arranged between the mounting ring and the orifice disc.

8. The fluid injector of claim 1, wherein the compensation element is arranged between the valve seat and the orifice disc.

9. The fluid injector of claim 1, wherein:

the orifice disc includes a plurality of spray openings configured to shape the spray of the fluid dispensed by the fuel injector in the open position of the valve, and the fastening element is a mounting ring that defines a central opening having a circumference located radially outward of all spray openings in the orifice disc such that the fastening element does not influence the fluid flow passing through the orifice disc.

10. A combustion engine, comprising:

a plurality of fluid injectors, each comprising:

a valve, a tubular valve body, an orifice disc, wherein the valve comprises a valve seat and a movable opening device interacting with the valve seat to open and close the valve, wherein the orifice disc is arranged at the valve seat on the opposite side of the opening device and is configured to shape a spray of the fluid dispensed by the fuel injector in an open position of the valve, a ring-shaped compensation element with a circular central hole, wherein the compensation element comprises at least one of: polytetrafluorethylene, a high temperature-resistant plastic, or a material that is not weldable to metal, and a fastening element secured to a cylindrical inner surface of the tubular valve body at a selectable location along a longitudinal length of the tubular valve body to compress the orifice disc and compensation element against the valve seat body, wherein the compression of the compensation element between the valve seat and the fastening element forms a circumferential seal against the cylindrical inner surface of the tubular valve body.

11. A fluid injector for injecting fuel into a combustion engine, the fluid injector comprising:

a valve comprising a valve seat body with a valve seat and a movable opening device interacting with the valve set to open and close the valve;

a tubular valve body;

an orifice disc attached to the valve seat body on the opposite side of the movable opening device and configured to shape a spray of the fluid dispensed by the fuel injector in an open position of the valve;

wherein the orifice disc moves relative to the valve seat body and the fastening element;

a ring-shaped compensation element with a central hole a fastening element secured to a cylindrical inner surface of the tubular valve body at a selectable location along a longitudinal length of the tubular valve body to compress the orifice disc and compensation element against the valve seat body, wherein the compression of the compensation element between the valve seat and the fastening element forms a circumferential seal against the cylindrical inner surface of the tubular valve body.

12. The fluid injector of claim 11, wherein the compensation element comprises at least one of the following materials: polytetrafluorethylene, a high temperature-resistant plastic, and a material that is not weldable to metal.

13. The fluid injector of claim 11, wherein the valve comprises an opening, wherein the opening device clears the opening in an open position of the valve, wherein the compensation element is ring-shaped and defines a central opening, and wherein the central opening overlaps with the opening of the valve.

14. The fluid injector of claim 11, wherein the fastening element is a mounting ring, wherein the mounting ring is connected to an inner peripheral surface of the valve body, and wherein the orifice disc is arranged between the mounting ring and the valve seat.

15. The fluid injector of claim 14, wherein the mounting ring provides a clamping connection to the inner peripheral surface of the valve body.

16. The fluid injector of claim 14, wherein the mounting ring is welded to the inner peripheral surface of the valve body.

17. The fluid injector of claim 14, wherein the compensation element is arranged between the mounting ring and the orifice disc.

18. The fluid injector of claim 11, wherein the compensation element is arranged between the valve seat and the orifice disc.

* * * * *